United States Patent [19]

Lappänen et al.

[11] Patent Number: 4,917,937

[45] Date of Patent: Apr. 17, 1990

[54] CLOTH FOR A PAPER MACHINE

[75] Inventors: Lasse Lappänen, Lempäälä ; Seppo Taipale, Siilinjärvi, both of Finland

[73] Assignee: Tamfelt Oy Ab, Tampere, Finland

[21] Appl. No.: 344,933

[22] Filed: Apr. 28, 1989

[30] Foreign Application Priority Data

Dec. 8, 1988 [FI] Finland ..... 885693

[51] Int. Cl.[4] ..... B32B 3/00

[52] U.S. Cl. ..... 428/196; 428/232; 428/292; 428/293; 428/294; 162/348; 162/DIG. 1

[58] Field of Search ..... 428/232, 292, 293, 294, 428/196; 162/348, DIG. 1

[56] References Cited

U.S. PATENT DOCUMENTS

| | | | |
|---|---|---|---|
| 2,098,909 | 11/1937 | Angier | 428/292 |
| 2,150,937 | 3/1939 | Novak | 428/292 |
| 2,703,771 | 3/1955 | Boulware et al. | 428/292 |
| 3,449,187 | 6/1969 | Bobkowicz | 428/293 |
| 3,506,420 | 4/1970 | Jackson | 428/292 |
| 3,523,867 | 8/1970 | MacBean | 162/348 |
| 3,652,390 | 3/1972 | Peterson | 162/DIG. 1 |
| 4,504,539 | 3/1985 | Petracek | 428/293 |
| 4,647,492 | 3/1987 | Grant et al. | 428/293 |

*Primary Examiner*—James J. Bell

*Attorney, Agent, or Firm*—Lowe, Price, LeBlanc, Becker & Shur

[57] ABSTRACT

The invention relates to a cloth for a paper machine, comprising a fabric formed of threads of a synthetic material. In the cloth, reinforcements extending substantially longitudinally of the cloth are positioned at predetermined points. The reinforcements are formed be feeding molten plastic material in a narrow stripe on to the surface of the cloth. In order to improve the wear properties of the wire, the directions of the stripes forming the reinforcement are arranged to deviate locally from the longitudinal direction of the cloth.

6 Claims, 1 Drawing Sheet

CLOTH FOR A PAPER MACHINE

The invention relates to a cloth for a paper machine, comprising a fabric formed by threads of a synthetic material, whereby reinforcements extending substantially longitudinally of the cloth are arranged at predetermined points in the cloth, the reinforcements being formed by feeding molten plastic material in a narrow stripe on to the surface of the cloth.

Paper machine cloths of this type are today well-known and are used, e.g., as wires. As is known, one problem with wires made of a synthetic material is that they wear out rapidly at certain points on the wear side of the wire. The wear side of the wire refers to that surface of the wire which is pressed against drawing rolls, for instance. Wires are particularly subject to wear within areas at a small distance from the edge of the wire. Wear is relatively rapid and, in practice, the wire has to be changed due to the wear occurring at such points while the rest of the wire may still be quite fit for use.

To avoid this problem, reinforcements made of a plastic material are provided in such wire edge portions. Known solutions include those disclosed in U.S. Pat. Nos. 3,523,867 and 3,652,390. The plastic material stripes used in these solutions are relatively broad. As a consequence, the edge portions of the wire become impermeable, so that they cannot be used in the dewatering.

In order to eliminate the problem associated with dewatering in the solutions of the above-mentioned U.S. Patent Specifications, it has been suggested that the broad reinforcing zone is replaced with several parallel reinforcing stripes extending in parallel with the longitudinal direction of the wire. Such a solution is disclosed in German Offenlegungsschrift No. 29 22 025. A drawback of this known solution is that fibre material is gathered around the reinforcing stripes, which degrades the final result.

The object of the invention is to provide a paper machine cloth by means of which the above-mentioned drawbacks can be eliminated. This is achieved by means of a paper machine cloth according to the invention, which is characterized in that the directions of the stripes forming the reinforcement are arranged to deviate from the longitudinal direction of the cloth at least locally.

An advantage of the invention is that the edge portions of the cloth can be used in dewatering; fibre material does not gather around the reinforcement; and the strength properties of the cloth are nevertheless particularly advantageous. A further advantage is that the invention is simple and thus advantageous to realize.

Figure 1:
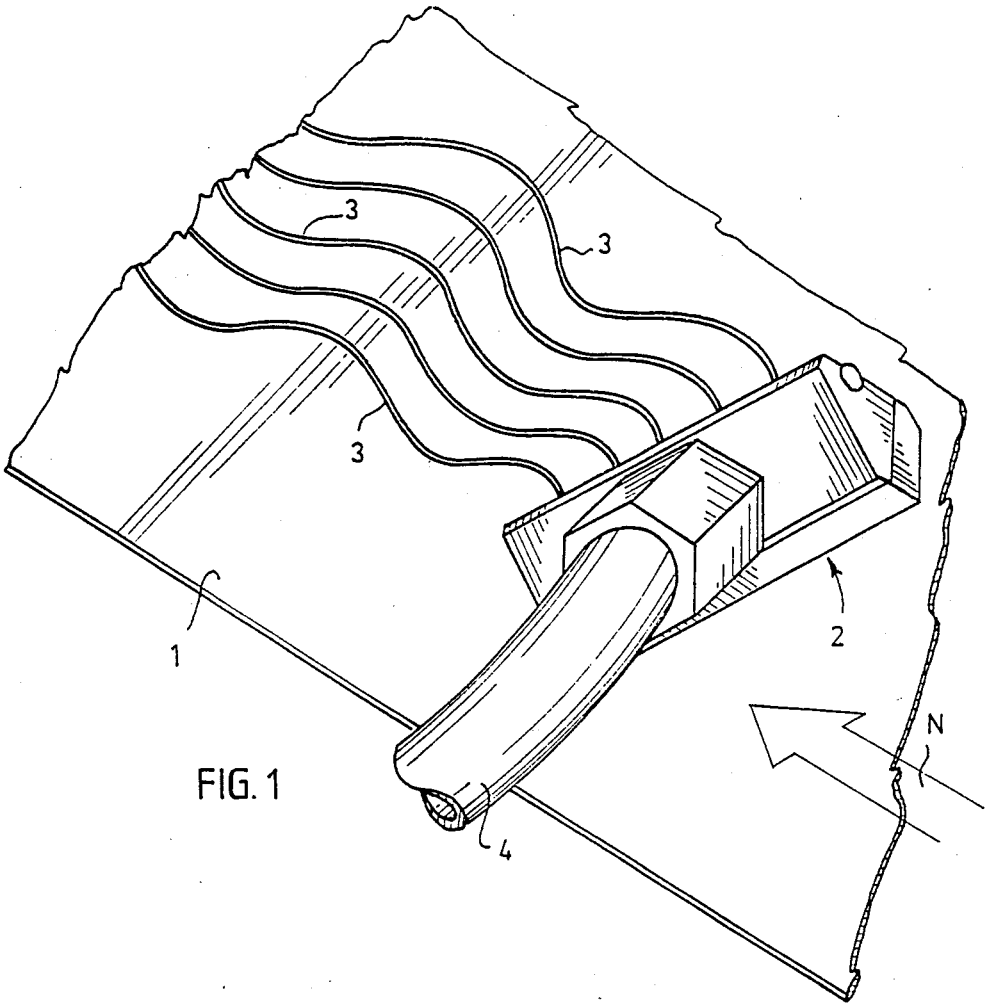

In the following the invention will be described by means of the embodiments shown in the attached drawings, wherein FIG. 1 is a general view of an arrangement for realizing the solution according to the invention; and FIGS. 2 to 5 show examples of the possible shapes of the stripes forming the reinforcement.

FIG. 1 shows generally an arrangement for realizing the solution according to the invention. The reference numeral 1 indicates a wire and the reference numeral 2 generally a nozzle distributor by means of which narrow stripes 3 forming the reinforcement are formed on the surface of the wire 1. The wire 1 may be of any conventional type. The structure of the wire is obvious to one skilled in the art, so the structure of the fabric of the wire will not be described in this connection.

In the example of FIG. 1, molten plastic material is led into a hose 4 wherefrom it is applied to the surface of the wire through the nozzle distributor 2.

The reinforcement stripes 3 are formed as follows. When the wire 1 moves in the direction of the arrow N, the nozzle distributor 2 is positioned on the surface of the wire 1 to be reinforced. Thereafter molten plastic material is began to be applied through the hose 4 into the nozzle distributor 2. The nozzle distributor is simultaneously moved in a predetermined manner in a direction transverse to the direction of movement of the wire. As a result, the molten material is introduced onto the surface of the wire 1, forming the stripes 3 reinforcing the wire. The directions of the stripes deviate locally from the longitudinal direction of the wire 1. The expression "deviate locally" means that the direction of the stripe 3 deviates at least at some points from the longitudinal direction of the wire, that is, from the direction of movement N, even though the reinforcements as a whole are parallel with the longitudinal direction of the wire. In the example of FIG. 1, each individual stripe 3 is wavy in the transverse direction of the wire even though the entire reinforcement (the stripes as a whole) extends longitudinally of the wire.

Figure 5:
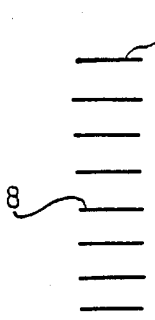
Figure 2:
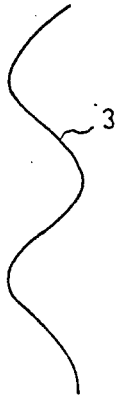
Figure 3:
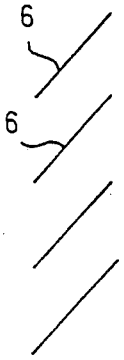
Figure 4:
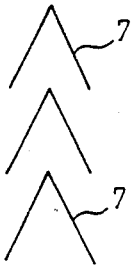

The movement of the nozzle distributor 2 can be controlled in any manner known per se. The operation of the nozzle distributor can, for instance, be controlled by a computer by means of which the desired stripe shape can be selected. In other words, the computer controls the movement of the nozzle distributor so that the desired shape of the reinforcing stripes is obtained. FIG. 2 shows generally the shape of one individual reinforcing stripe 3 in the embodiment of FIG. 1. FIGS. 3, 4 and 5 show examples of other possible shapes of the reinforcing stripes. In FIG. 3, the reinforcing stripe is formed by stripes 6 of a predetermined length which are arranged in an angular position with respect to the longitudinal direction of the wire. In the embodiment of FIG. 4, the reinforcing stripe is formed by substantially V-shaped patterns 7 which are positioned one after another in the longitudinal direction of the wire. In the embodiment of FIG. 5, the reinforcing stripe is formed by transverse stripes 8 positioned one after another in the longitudinal direction of the wire. In the examples of FIGS. 2 to 5, the longitudinal direction of the wire is the vertical direction in the plane of the paper.

The reinforcing stripes are provided on the wear surface of the wire, that is, on the surface which is to be pressed against the drawing rolls, suction boxes, etc. The reinforcing stripes rise slightly from the surface of the wire, thus acting as wear portions so that the wear resistance of the wire is improved. The reinforcing stripes do not, however, hamper the dewatering, in addition to which no disadvantageous fibre material gathers around the stripes.

Examples described above are by no means intended to restrict the invention, but the invention can be modified within the scope of the claims in various ways. Accordingly, it is obvious that the stripes can be formed by means of a device different from that described in the application. The shape of the stripes is not restricted. The number of the stripes may also vary according to the requirements in each particular case. The stripes can be positioned on the wire completely as required, depending on where the wear is at maximum and where the wear is most problematic.

We claim:

1. A cloth for a paper machine, comprising a fabric formed by threads of a synthetic material, whereby reinforcements extending substantially longitudinally of the cloth are arranged at predetermined points in the cloth, the reinforcements being formed by feeding molten plastic material in a narrow stripe on to the surface of the cloth, and the directions of the stripes forming the reinforcement being arranged to deviate from the longitudinal direction of the cloth at least locally.

2. A cloth according to claim 1, wherein the stripes forming the reinforcement are stripes wavy in the transverse direction of the cloth.

3. A cloth according to claim 1, wherein the reinforcements are formed by stripes of a predetermined length, the stripes being at an angular position with respect to the longitudinal direction of the cloth.

4. A cloth according to claim 1, wherein the stripes forming the reinforcement are arranged to form substantially V-shaped patterns positioned one after another in the longitudinal direction of the cloth.

5. A cloth according to claim 1, wherein the stripes forming the reenforcement are stripes extending in the transverse direction of the cloth.

6. A cloth according to claim 1, wherein the stripes forming the reinforcement are arranged to be positioned over the whole width of the cloth.

* * * * *